US007857607B2

(12) United States Patent
Bishop et al.

(10) Patent No.: US 7,857,607 B2
(45) Date of Patent: Dec. 28, 2010

(54) ROTARY LOBE PUMP

(75) Inventors: Lee Bishop, Hoddesdon (GB); Michael Young, London (GB)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 697 days.

(21) Appl. No.: 11/888,927

(22) Filed: Aug. 3, 2007

(65) Prior Publication Data

US 2008/0038138 A1 Feb. 14, 2008

(30) Foreign Application Priority Data

Aug. 11, 2006 (GB) ..... 0616034.5

(51) Int. Cl.
*F01C 1/18* (2006.01)
*F01C 1/24* (2006.01)
*F03C 2/00* (2006.01)

(52) U.S. Cl. ..... 418/206.1; 418/1; 418/152; 418/179; 418/206.9

(58) Field of Classification Search ..... 418/1, 418/152, 178, 179, 206.1, 206.5–206.9
See application file for complete search history.

(56) References Cited

U.S. PATENT DOCUMENTS

| | | | | |
|---|---|---|---|---|
| 3,291,059 | A * | 12/1966 | Werra | 418/179 |
| 3,859,014 | A * | 1/1975 | Dworak et al. | 418/152 |
| 4,532,990 | A * | 8/1985 | Perkins | 166/248 |
| 4,979,885 | A * | 12/1990 | Yasuda et al. | 418/270 |
| 5,567,140 | A | 10/1996 | Dodd | |
| 6,203,297 | B1 * | 3/2001 | Patel | 418/206.1 |
| 6,325,604 | B1 * | 12/2001 | Du | 418/152 |

FOREIGN PATENT DOCUMENTS

| | | |
|---|---|---|
| EP | A-0 391 182 | 10/1990 |
| EP | A-0 859 152 | 8/1998 |

* cited by examiner

*Primary Examiner*—Theresa Trieu
(74) *Attorney, Agent, or Firm*—Peter Van Winkle

(57) ABSTRACT

A rotary lobe pump comprises a pump body having a driving means and an outer casing, and an insert that can be replaced. The replaceable insert comprises a housing formed of a plastic material and having an inlet port, an outlet port and internal surfaces defining a pumping chamber. The replaceable insert also includes a pair of lobed rotors arranged for rotation within the pumping chamber. The housing includes apertures through which the lobed rotors may be rotationally driven, so that the lobed rotors mesh together for pumping a fluid from the inlet port to the outlet port.

10 Claims, 6 Drawing Sheets

ROTARY LOBE PUMP

CROSS-REFERENCE

Applicant claims priority from British patent application No. 0616034.5 filed 11 Aug. 2006.

BACKGROUND OF THE INVENTION

This invention relates to rotary lobe pumps. Rotary lobe pumps are used in industry for positive-displacement pumping of foodstuffs, pharmaceuticals, and other similar materials. When handling these materials, it is important that cross-contamination and chemical interaction with other materials are avoided.

Known rotary lobe pumps include provision for dismantling by the user. In this way, components of the pump that come into contact with the pumped material can be cleaned and sterilized between different batches. A problem associated with this cleaning and sterilization process is that it is time consuming and prone to errors. Any errors in the cleaning process may result in contamination of the pumped material and/or loss of production.

In general, components of rotary lobe pumps are manufactured with high dimensional accuracy and low tolerances. It is particularly important that the form of the lobed rotors and the walls of the pumping chamber are accurately controlled, so as to achieve the desirable characteristics of low noise and wear and high efficiency. In known pumps, the required accuracy is achieved by machining components from metal, for example stainless steel.

SUMMARY OF THE INVENTION

According to the invention, there is provided an insert for an outer casing of a rotary lobe pump, the insert comprising a housing formed of a plastic material and having an inlet port, an outlet port and internal surfaces defining a pumping chamber. The insert also includes a pair of lobed rotors arranged for rotation within the pumping chamber, wherein the housing includes apertures through which the lobed rotors may be rotationally driven, so that the lobed rotors mesh together for pumping a fluid from the inlet port to the outlet port.

The invention thus provides a plastic insert which includes all of the components of a rotary lobe pump that come into contact with the pumped material during normal operation. The insert does not include the components of the pump that do not come into contact with the pumped material, including the drive means. The insert can be used with an associated pump body to provide a working rotary lobe pump. The insert can then be replaced between batches of pumped product to prevent cross-contamination. In certain embodiments, the insert is a disposable, "single use" product and may be pre-sterilized and provided in sealed packaging.

The housing may be formed of two shells that are welded together. The shells may alternatively be bolted together with a seal provided there between. In either case, the shells may be molded components having a nominal wall thickness in the range 0.5 mm to 10.0 mm, preferably in the range 0.8 mm to 8.0 mm and most preferably in the range 1 mm to 5 mm. A plastic housing having this wall thickness would not, by itself, typically have the strength to maintain its form under normal internal operating pressures. However, the insert may be received in the stiffer outer casing of the pump to provide additional support.

External surfaces of the housing may include raised portions for locating the insert within the outer casing. The dimensional accuracy of these raised portions may then be accurately controlled. External surfaces of the housing may also include stiffening ribs.

The inlet port and the outlet port may each include a detachable sealing means for preventing contamination of the pumping chamber prior to use. The sealing means may then be detached immediately prior to use.

The lobed rotors may be formed of a rigid plastic material, and may for example be molded.

The lobed rotors may each include an axial aperture for receiving a drive shaft. In this case, the aperture of each lobed rotor is arranged in registration with a respective aperture of the housing to enable the drive shaft to be fully received by the rotor. The aperture of each lobed rotor may include a keyway for driving the lobed rotor. The axial apertures of the rotors may be provided with sleeves having an axial length greater that the axial length of the rotors. The sleeves may be formed of a metal, such as stainless steel, to provide a surface against which seals may act.

The lobed rotors may each include an integral axial shaft through which the aperture is provided, i.e. in the form of a sleeve. The shaft of each lobed rotor is then rotationally mounted in a respective aperture or apertures of the housing so as to maintain alignment of the apertures in the rotors and housing.

The boundary between the rotor and the housing may form a seal for the pumped material. A separate lip seal may additionally be provided at the boundary for improved sealing performance.

The pumping chamber and the lobes of the rotors may taper down in the axial direction from a front to a rear of the insert. With this arrangement, the insert may only be inserted in the outer casing in one orientation. Such an arrangement may also simplify the molding of the housing and minimize the risk of the insert becoming jammed in the outer casing.

The tips of the rotor lobes may be provided with a taper in the axial direction and the roots of the rotor lobes may be provided with an opposite taper in the axial direction. In this way, the clearance between the rotors is minimised and thus leakage from outlet to inlet is reduced.

According to another aspect of the invention, there is provided a rotary lobe pump body for use with the insert described above, the pump body comprising: a drive means having a pair of parallel output shafts arranged for rotation; and an outer casing having internal surfaces for receiving, contacting and supporting the insert so that each output shaft engages with a respective lobed rotor for driving the lobed rotor.

The pump body includes the components of the pump which do not generally come into contact with the pumped material. A clamping mechanism may be provided for accurately holding the insert in the axial direction.

Each of the output shafts may include a keyway for driving a respective lobed rotor. Internal surfaces of the outer casing may include raised portions for locating the insert. The outer casing may be formed of a metallic material.

The pump body may further comprise a closing plate for maintaining the insert within the outer casing. In this case, the output shafts may each be provided with a resilient means, such as a compression spring or washer, for urging the insert against the closing plate. The closing plate may be provided with thrust bearings so as to avoid friction between the rotors and the closing plate.

According to another aspect of the invention, there is provided a rotary lobe pump comprising the insert described above and the rotary lobe pump body described above, wherein the insert is received in and is in contact with the internal surfaces of the outer casing, so that each output shaft is engaged with a respective lobed rotor for driving the lobed rotor.

Embodiments of the invention will now be described, by way of example only, with reference to the accompanying drawings.

DESCRIPTION OF THE INVENTION

The invention provides a rotary lobe pump comprising a pump body and an insert. The pump body includes the components of the pump that do not generally come into contact with the pumped material. The insert is a plastic component that includes the components of the pump that do come into contact with the pumped material, namely the pumping chamber and the lobed rotors. The insert is closely (to avoid rattling) received in and supported by an outer casing of the pump body.

Figure 1:
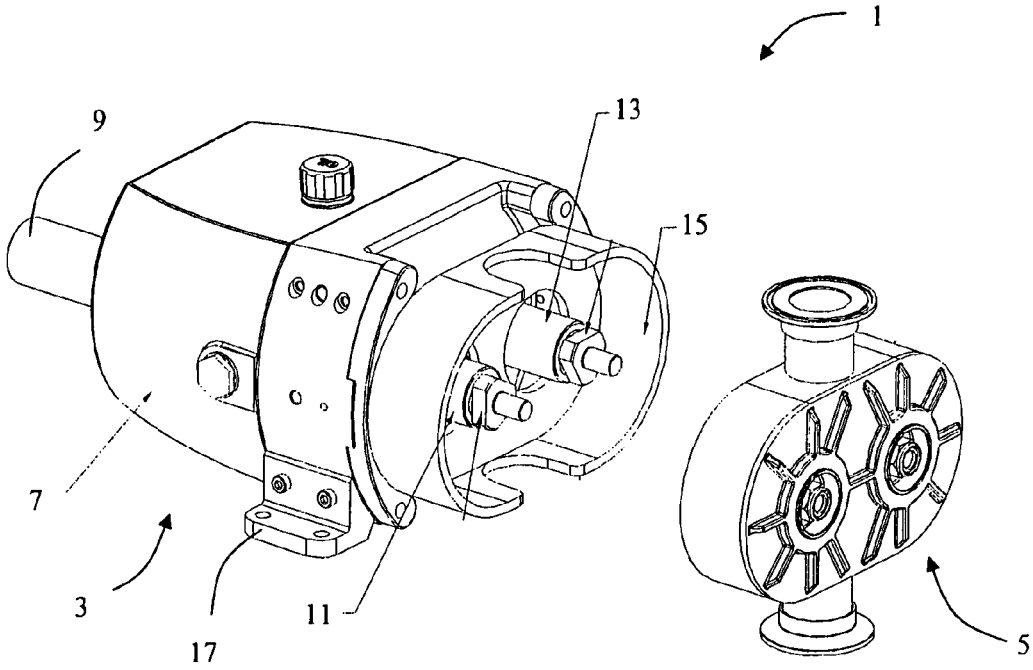
FIG. 1 is an exploded isometric view of a pump body and an insert which together form a rotary lobe pump according to the invention.

FIG. 1 shows a rotary lobe pump 1 according to the invention. The pump 1 includes a pump body 3 and a plastic insert 5.

The pump body 3 comprises drive means in the form of a gearbox 7. The gearbox 7 has an input shaft 9 at one end and two output shafts 11, 13 at the other end. The gearbox 7 is arranged so that the output shafts 11, 13 rotate at the same angular speed but in opposite directions. The output shafts 11, 13 are provided with keys (not shown) for rotationally driving other elements.

The aspects of the pump body 1 described above are conventional, and will therefore be known to the skilled person. A detailed explanation of the structure and operation of the gearbox 7 and output shafts 11, 13 will therefore be omitted from this description.

The pump body 3 additionally comprises walls forming a cavity or outer casing 15 for receiving the plastic insert 5. The outer casing 15 is a separate component that is bolted to the gearbox 7.

The outer casing 15 includes internal surfaces that define a base and sides for receiving the insert 5. The outer casing 15 is formed of a metal, and the base and sides have high rigidity and high dimensional accuracy. The output shafts 11, 13 of the gearbox 7 project through the base of the outer casing 15. Opposite sides of the outer casing 15 are provided with cutouts for accommodating inlet and outlet ports of the insert 5.

The pump body 3 additionally has mounting means in the form of brackets 17. The brackets 17 are used to attach the pump body 3 to a rigid base (not shown).

Figure 2:
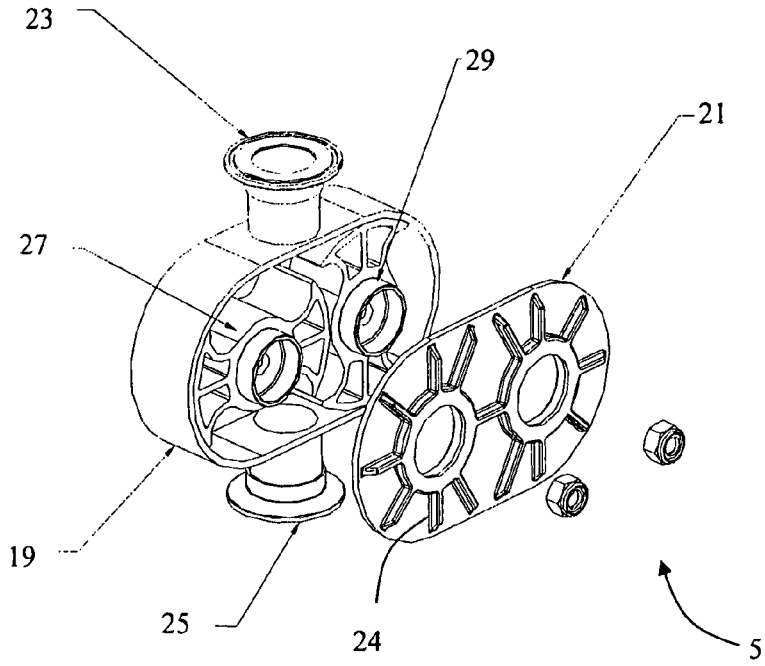
FIG. 2 is an isometric view showing the main components of the insert shown in FIG. 1.
Figure 3:
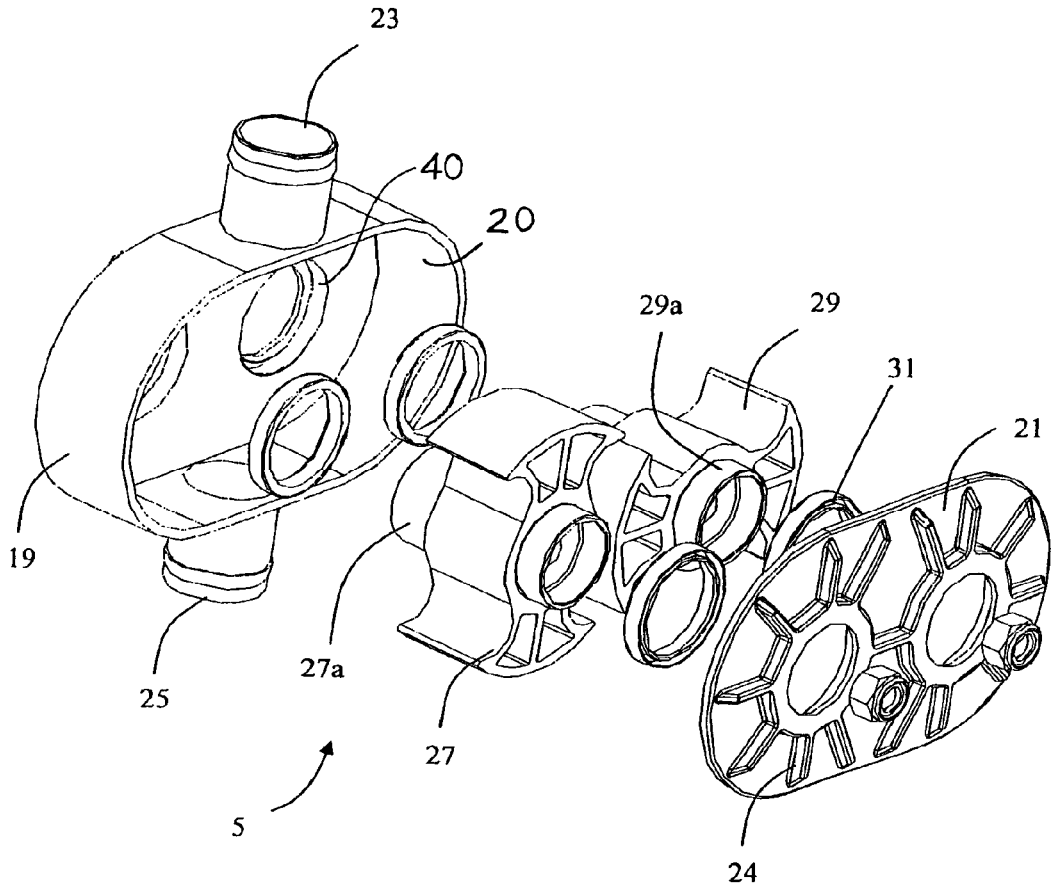
FIG. 3 is an exploded isometric view showing the components of the insert shown in FIG. 1 in more detail.

FIG. 2 shows the plastic insert 5 in component form and FIG. 3 shows the insert 5 in more detail and in exploded form.

As can be seen, the insert 5 includes first and second molded plastic shells 19, 21. The first shell 19 includes internal surfaces that define the base and sides of a pumping chamber 20. The first shell 19 also includes inlet and outlet ports 23, 25 provided in opposite sides of the pumping chamber. The first shell has apertures 40 through the lobe rotor shafts and outer shafts projects.

The second shell 21 is essentially a cover for the first shell 19 and is welded to the first shell 19 to provide a sealed joint. External surfaces of the second shell 21 include strengthening ribs 24.

Both shells 19, 21 include circular apertures for receiving the drive shafts 11, 13 of the pump body 3 shown in FIG. 1. The wall thickness of the shells is about 2 mm.

Referring again to the Figures, the insert 5 also includes a pair of lobed rotors 27, 29. The rotors 27, 29 each have two lobes that are arranged to mesh together when they are rotated in opposite directions, so as to provide a pumping action. The pumping action pumps the pumped material from the inlet port 23 to the outlet port 25. The particular form of the rotors will be well known to those skilled in the art of rotary lobe pumps and a detailed explanation will therefore be omitted from this description.

The lobed rotors 27, 29 are plastic components molded with integral axial shafts 27*a*, 29*a*. Each end of each shaft 27*a*, 29*a* is received in a corresponding aperture in the shells 19, 21. A lip seal 31 is provided on each end of each shaft 27*a*, 29*a*, between the rotor 27, 29 and the shell 19, 21, to seal the pumping chamber.

The insert 5 is shaped so that it fits into the outer casing 15 of the pump body 3 with a minimal gap there between, but an interference fit is not required. In fact, the outer surfaces of the first shell 19 of the insert 5 and the inner surfaces of the outer casing 15 are designed so that they are substantially in contact across almost their entire area. Both the first shell 19 of the insert 5 and the outer casing 15 of the pump body 3 are provided with a slight taper in the axial direction. This taper enables the insert 5 to be received in the outer casing 15 more easily and without becoming jammed.

In use, the pump body 3 is typically provided as fixed equipment for use in an industrial process. In particular, the pump body 3 is located in an environment which, although clean, is not sterile. The insert 5 is provided as a pre-sterilized product in sealed packaging.

The insert 5 is removed from the packaging and inserted in the outer casing 15 of the pump body 3, so that the drive shafts 11,13 are received by the rotors 27, 29. The inlet port 23 and outlet port 25 of the insert 5 are then connected to pipes from and to which the pumped material is to be pumped. The pumping chamber of the insert 5 is at risk of contamination for a minimal amount of time.

Once connected, the pump body 3 and insert 5 are operated as a normal rotary lobe pump. More specifically, the input shaft 9 of the pump body is rotationally driven and the gearbox 7 transfers the rotation to the output shafts 11, 13, which rotate in opposite directions. The output shafts 11, 13 drive the lobed rotors 27, 29 in opposite directions to pump the pumped material.

During use, a pressure inside the pumping chamber of the insert 5 increases. Normally, this pressure would cause distortion of the thin walled shells 19, 21. However, the first shell 19 is supported by the internal surfaces of the outer casing 15.

The smaller second shell 21, which is not supported by the rigid outer casing 15, includes stiffening ribs 24. As a result of these features, the dimensional accuracy of the pumping chamber is maintained.

Furthermore, the dimensional accuracy of the plastic shells 19, 21 is not critical, provided their wall thickness is controlled. This is because, in use, the shells 19, 21 conform to the accurate surfaces of the outer casing 15 due to the higher pressure in the pumping chamber.

Figure 4:
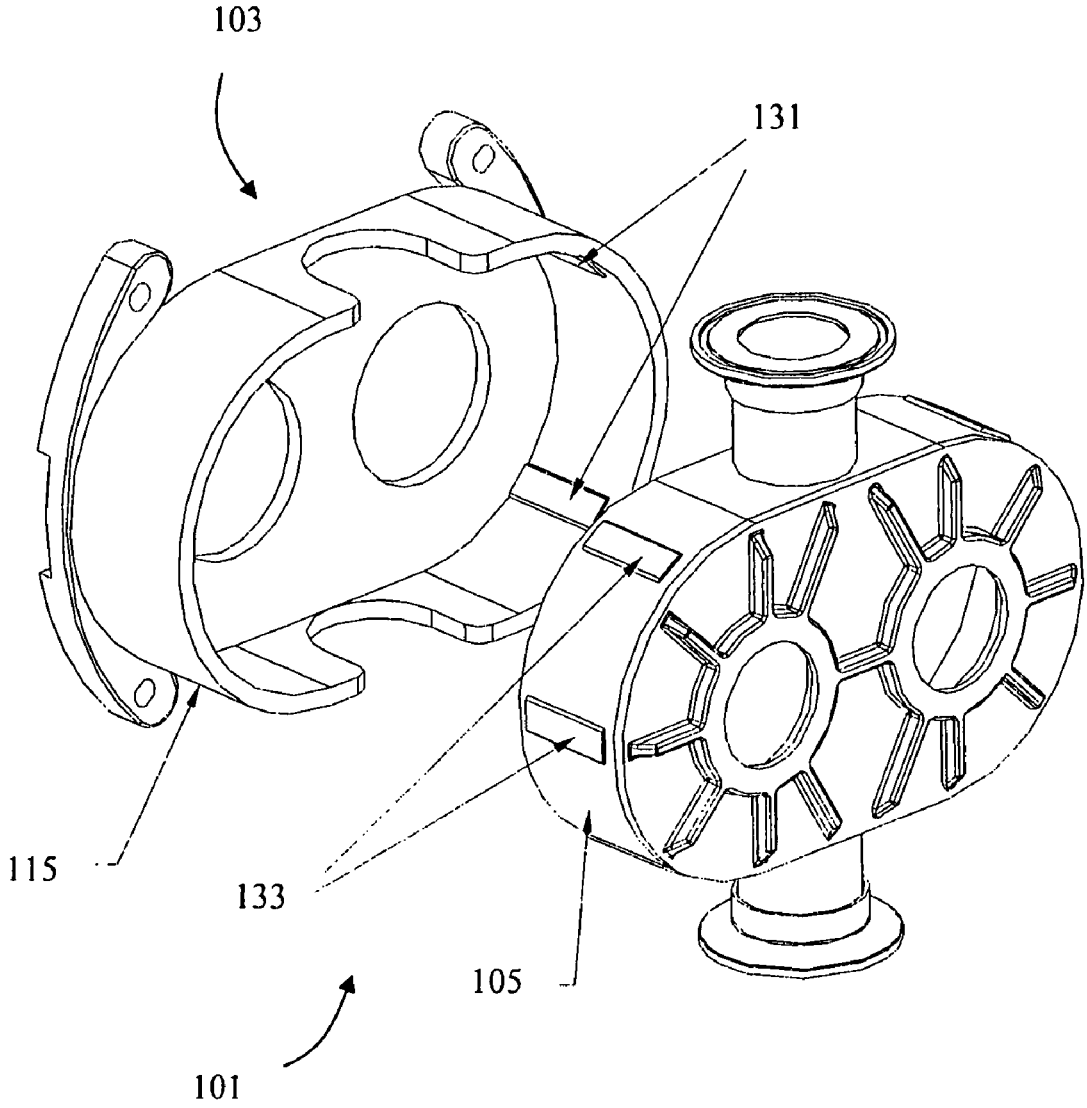
FIG. 4 is an exploded isometric view showing part of a pump body and an insert which together provide another rotary lobe pump according to the invention.

FIG. 4 shows part of a pump body 103 and an insert 105 which together provide an alternative rotary lobe pump 101 according to the invention. The pump body 103 and insert 105 are the same as those described above with respect to FIGS. 1 to 3, except that the internal surfaces of the outer casing 115 and the external surfaces of the insert 105 are provided with raised portions 131, 133 for use in locating the insert 105 within the outer casing 115. The dimensional accuracy of the raised surfaces 131, 133 can be accurately controlled, for example by machining after molding or casting processes. The raised surfaces 131, 133 may have an interference fit.

Figure 5A:
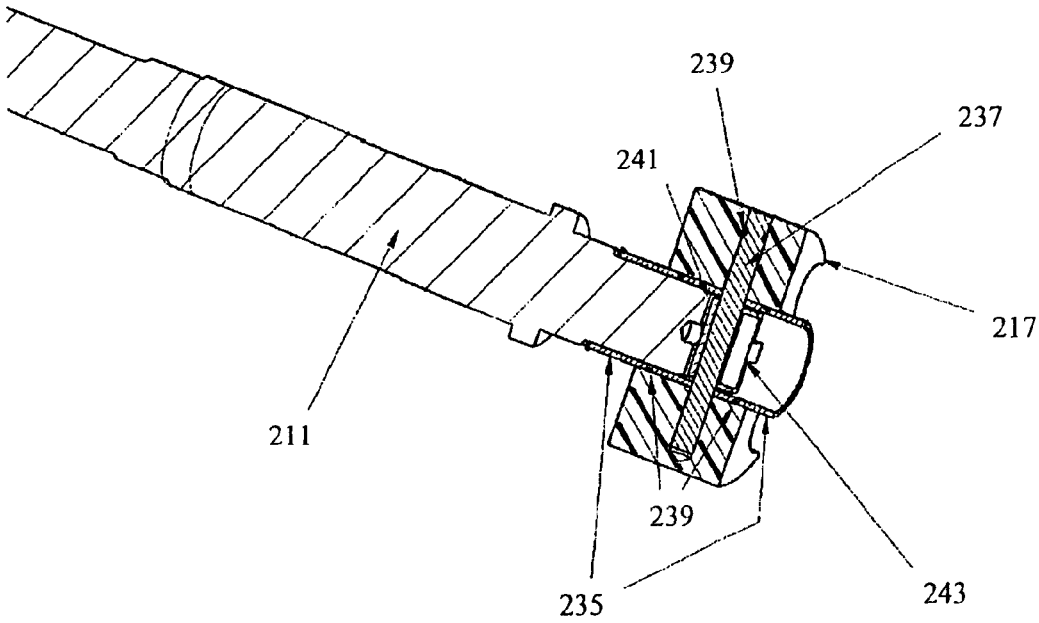
FIGS. 5*a* and 5*b* show an arrangement for providing sealing between a rotor and a housing of another insert according to the invention.
Figure 5B:
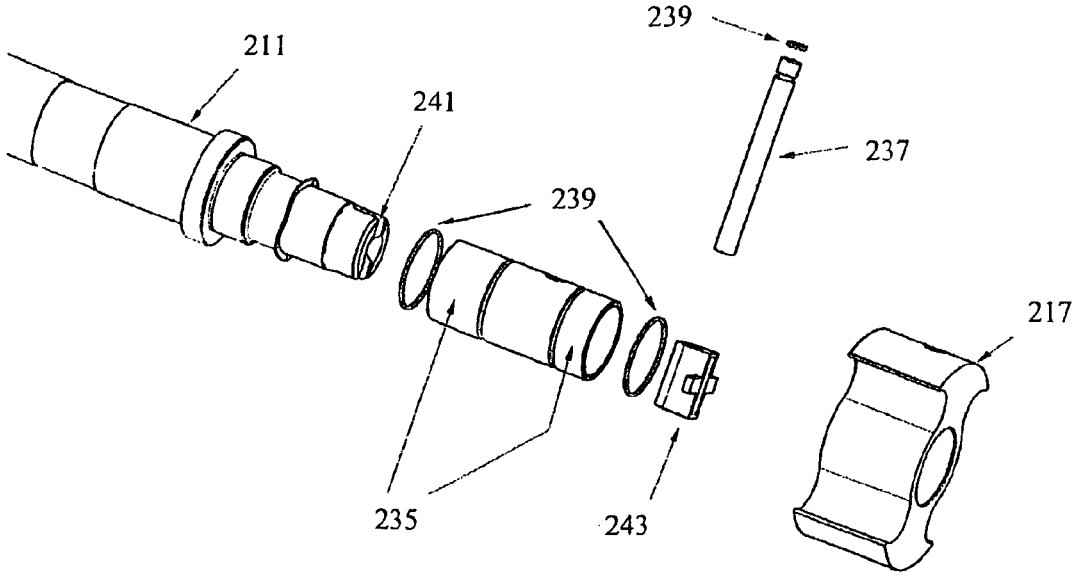

FIGS. 5*a* and 5*b* show, in assembled and exploded form respectively, an arrangement for providing improved sealing between a rotor 217 and a housing (not shown) of another insert according to the invention. Referring to these Figures, there is shown a rotor 217 of an insert attached to a drive shaft 211, which drive shaft 211 may form part of the insert or a pump body. For the sake of clarity, neither the insert nor the pump body are shown, but their construction would be similar to that shown in FIG. 1. It should, in particular, be noted that a pump would comprise a pair of the rotor 217 and drive shaft 211 arrangements shown in FIGS. 5*a* and 5*b*.

An axial aperture formed in the rotor 217 for receiving the drive shaft 211 and this aperture is provided with a stainless steel sleeve 235. The sleeve 235 is axially located within the aperture by a pin 237 that passes through the rotor 217 and the sleeve 235. A number of o-ring seals 239 are provided between the sleeve 235 and the rotor 217 and between the pin 237 and the rotor 217 for sealing against ingress of the pumped fluid.

The free end face of the drive shaft 211 is provided with a slot 241 for engaging with the pin 237 to drive the rotor 217. A separate locating piece 243 is provided for centralizing the pin 237 in the slot 241 of the drive shaft 211.

As can be seen in FIG. 5*a*, the axial length of the sleeve 235 is greater than that of the rotor 217 so that, in the assembled condition, the sleeve extends in an axial direction beyond both faces of the rotor 217. These exposed surfaces of the sleeve 235 may be provided with seals, such as those described above with reference to FIG. 3. By providing a metal surface for the seals to seal against, the sealing performance may be improved, especially for pumped fluids having poor lubricity, such as water.

Figure 6A:
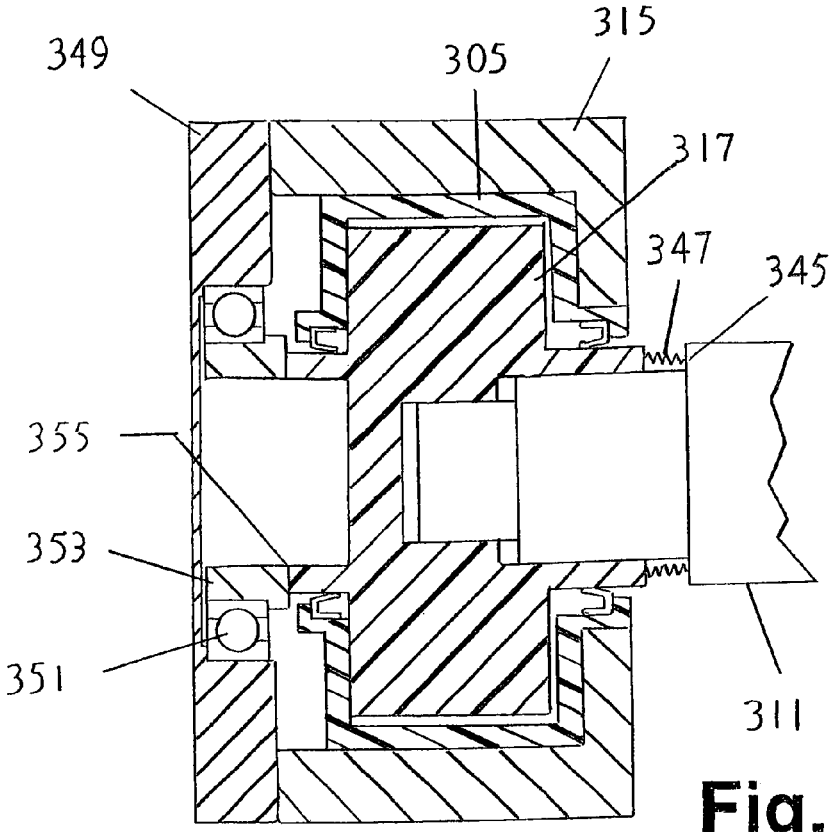
FIGS. 6*a* and 6*b* show an arrangement for controlling axial clearances between a rotor and a housing of another insert according to the invention.
Figure 6B:
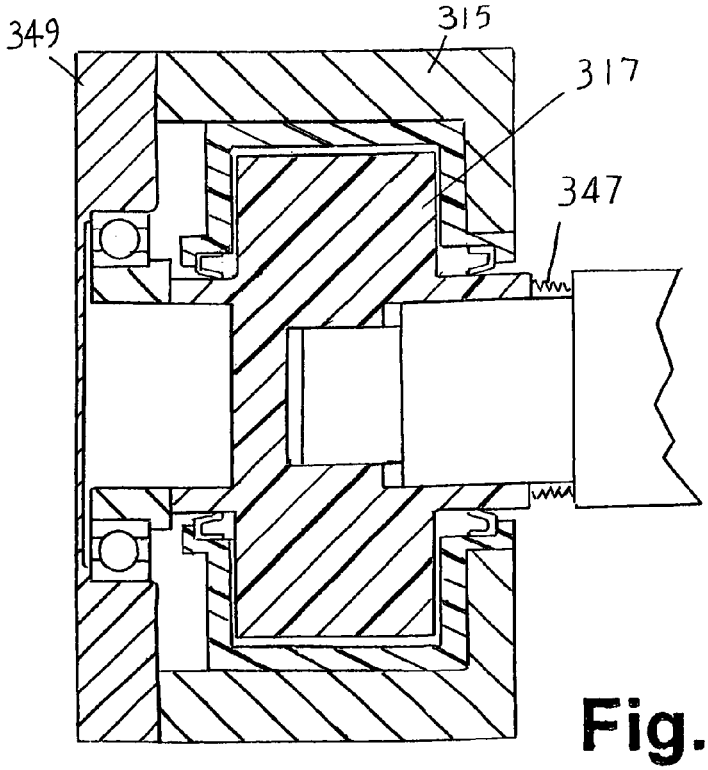

FIGS. 6*a* and 6*b* show an arrangement for controlling axial clearances between a rotor 317 and a plastics housing of another insert 305 according to the invention. Referring to these Figures, there is shown a pump body 303 having an outer casing 315 and a pair of drive shafts 311, only one of which drive shafts 311 is shown. The drive shaft 311 is provided with a shoulder 345 on which is mounted a compression spring washer 347.

The pump body 303 also comprises a closing plate 349 for clamping against the outer casing 315 of the pump body 303. The closing plate 349 comprises a thrust bearing 351, the inner race of which is provided with a collar 353.

Within the outer casing 315 of the pump body 303 is provided an insert 305 comprising a plastics housing and a pair of rotors 317 mounted within the housing, only one of which rotors 317 is shown. The rotor 317 is provided with an integrally molded axial shaft 355 which extends from the rotor 317 in both axial directions. The axial shaft 355 is formed with an axial aperture for receiving the drive shaft 311 of the pump body 303. Seals of the type described with reference to FIG. 3 are provided between the rotor 317 and the housing.

In use, the insert 305 is received into the outer casing 315 of the pump body 303, and the shaft 311 of the pump body 303 is received into the axial aperture of the rotor 317, as shown in FIG. 6*a*. At this time, a first end of the axial shaft 355 of the rotor 317 is urged against the compression spring washer 347 mounted on the drive shaft 311 of the pump body 303. This action causes the opposite axial end face of the rotor 317 to bear against the internal surface of the insert 305, as shown in FIG. 6*a*.

Next, the axial position of the collar 353 of the closing plate 349 is adjusted so that it bears against the second end of the axial shaft 355 of the rotor 317, and displaces the rotor 217, against the force of the compression spring washer 347, until a controlled gap is opened up between the axial end face of the rotor 317 and the internal surface of the insert 305, as shown in FIG. 6*b*. In this way the axial clearance between the end faces of the rotor 317 and the internal surfaces of the insert 305 can be accurately set and controlled.

Figure 7A:
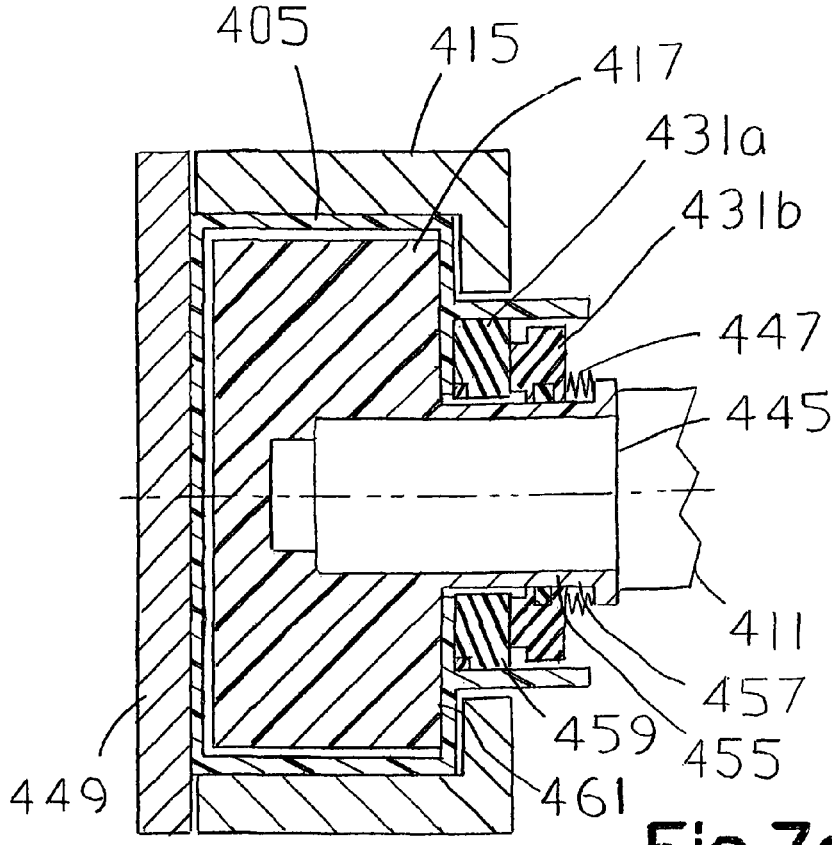
FIGS. 7*a* and 7*b* show another arrangement for controlling axial clearances between a rotor and a housing of another insert according to the invention.
Figure 7B:
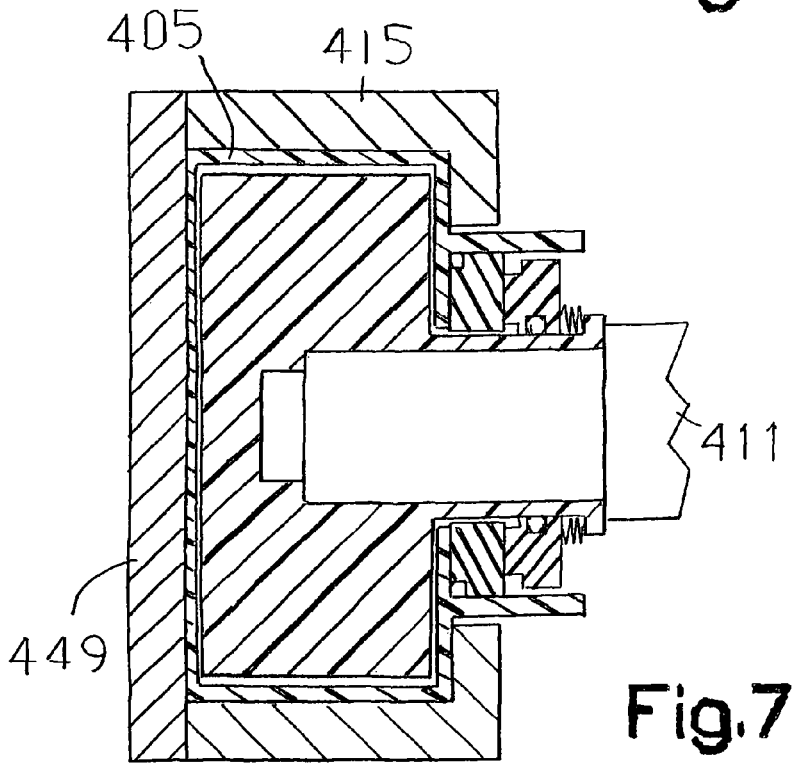

FIGS. 7*a* and 7*b* show another arrangement for controlling axial clearances between a rotor 417 and a plastics housing of another insert 405 according to the invention, which insert is similar to that shown in FIGS. 6*a* and 6*b*. Referring to FIGS. 7*a* and 7*b*, there is shown a pump body having an outer casing 415 and a pair of drive shafts 411, only one of which drive shafts 411 is shown. The drive shaft 411 is provided with a shoulder 445. The pump body also comprises a closing plate 449 for clamping against the outer casing 415 of the pump body.

Within the outer casing 415 of the pump body is provided an insert 405 comprising a plastics housing and a pair of rotors 417 mounted within the housing, only one of which rotors 417 is shown.

The rotor 417 is provided with an integrally moulded axial shaft 455 which extends from the rotor 417 in one axial direction only, away from the closing plate 449 of the pump body. The axial shaft 455 is formed with an axial aperture for receiving the drive shaft 411 of the pump body. A circumferential flange 457 is provided at the end of the axial shaft 455, the outer surface of which is arranged to bear against the shoulder 445 formed in the drive shaft 411.

A seal 431*a*, 431*b* is provided between the rotor 417 and the plastics housing of the insert 405. The seal 431*a*, 431*b* comprises a stationary part 431*a* attached to a flange 459 of the plastics housing which faces the circumferential flange 457 of the rotor 417, and a moving part 431*b* which is attached to the axial shaft 455 of the rotor 417. During rotation of the rotor 417, a contact surface of the stationary part 431*a* rubs against a contact surface of the moving part 431*b*. The contact surfaces are sufficiently flat to avoid leakage of the pumped fluid therebetween. Seals of this type are well known to those skilled in the art, and a detailed description thereof will accordingly be omitted.

In use, the insert 405 is received into the outer casing 415 of the pump body, and the shaft 311 of the pump body is received into the axial aperture of the rotor 317, as shown in FIG. 7*a*. Before the closing plate 449 is clamped against the outer casing 415 of the pump body, the stationary and moving parts of the seal 431*a*, 431*b* together with the flange 459 of the plastics housing are urged against the rotor 417, as shown in the Figure, by the action of a spring member 447 which is seated on the circumferential flange 457 of the axial shaft 455.

Next, the axial position of the closing plate 449 is adjusted so that it bears or clamps against a surface of the plastics housing, as shown in FIG. 7*b*. As the closing plate 449 is moved axially, it displaces the plastic housing of the insert 405 against the action of the spring member 447. The axial position of the rotor 417 is, however, fixed by the bearing of the circumferential flange 457 of the rotor 417 against the shoulder 445 of the drive shaft 411. Thus, the plastics housing of the insert 405 is displaced relative to the rotor 417. In this way the axial clearance between the end faces of the rotor 417 and the internal surfaces of the insert 405 can be accurately set and controlled.

Exemplary embodiments of the invention have been described above. The skilled person will recognize that various modifications and changes may be made to these embodiments without departing from the scope of the invention, which is defined by the accompanying claims.

For example, in the above embodiment, keys are used to couple the drive shafts to the rotors. However, other coupling means may alternatively be employed, such as dogs.

The insert described above is formed of two molded plastic shells welded together. However, the shells may alternatively be bolted together with a sealing element provided there between.

The second shell of the insert described above includes stiffening ribs, and is not therefore supported by the outer casing of the pump body. However, the outer casing may alternatively (or additionally) have a cover for providing support for the second shell.

The pump body may be provided with a clamping mechanism for maintaining the surfaces of the outer casing and the insert in intimate contact.

Suitable materials for the housing and rotors of the insert include polyetheretherketone (PEEK) and acetyl homopolymers, such as polyoxymethylene (Delrin). However, other materials may be suitable for the housing and rotors, such as metals, ceramics and composite materials. Applicant notes that engineering metals commonly used for housings have a strength and rigidity more than five times that of plastics, as is measured by their Young's modulus of elasticity.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An insert (5) for an outer casing (15) of a rotary lobe pump, the insert comprising:

a housing (19) having an inlet port (23), an outlet port (25), and internal surfaces defining a pumping chamber (20); and a pair of lobed rotors (27, 29) arranged for rotation within the pumping chamber;

wherein the housing includes apertures (40) through which the lobed rotors are rotationally driven, so that the lobed rotors mesh together for pumping a fluid from the inlet port to the outlet port; and wherein said housing has external surfaces that include raised portions for locating the insert within the outer casing.

2. A rotary lobe pump, comprising:

a metal pump body with pump body walls that form a cavity;

a pair of driven pump shafts;

an insert that fits closely in said cavity, said insert including a plastic shell having inlet and outlet ports and having walls forming a pumping chamber, and said insert including a pair of plastic lobed rotors that are rotatable in said pumping chamber, said pump body walls that form a cavity are of a material more rigid than the plastic of said shell and of said lobes;

said shell including a pair of shaft apertures with axes, said driven pump shafts lie on said axis, and said lobes include lobe shafts that are mounted on said pump shafts and being rotatable about said axes, said axes being positioned to mesh the lobed rotors together to pump a fluid from the inlet port to the outlet port;

said insert shell has an outer surface with raised portions that accurately locate the insert within walls of the cavity of the pump body.

3. A rotary lobe pump, comprising:

a metal pump body that has walls forming an insert-holding cavity with a pair of shaft apertures and forming a gearbox holding portion;

a gearbox mounted in said gearbox holding portion and having a pair of gearbox shafts that project through said shaft apertures into said insert-holding cavity;

an insert that includes a shell and a pair of plastic lobe rotors, said shell fits closely in said cavity, said shell forms a lobe pumping chamber, said shell has a pair of shell holes aligned with said shaft apertures, and said shell has inlet and outlet ports;

said lobe rotors fit over said gearbox shafts and lie in said pumping chamber, and said lobe rotors pump fluid from one of said ports to the other when said lobe rotors rotate in opposite directions;

said insert shell is a molded plastic part and includes an outer surface with raised portions, said raised portions being machined to fit closely in said cavity.

4. A replaceable insert (5) for a rigid metal outer casing (15, 115) of a rotary lobe pump, the insert comprising:

an insert housing (19, 21) having an inlet port (23), an outlet port (25) and internal surfaces defining a pumping chamber (20); and a pair of lobed rotors (27, 29) arranged for rotation within the pumping chamber;

wherein the insert housing (19, 21) includes apertures through which the lobed rotors (27, 29) extend with the rotors being rotationally driven, so that the lobed rotors (27, 29) mesh together for pumping a fluid under a normal internal operating pressure from the inlet port (23) to the outlet port (25);

wherein said insert housing must have a predetermined ideal shape to allow said rotors to rotate and to allow said rotors to pump said fluid;

and wherein said insert housing is of plastic and has a wall thickness that is thin enough that the housing (19, 21) would not have sufficient strength to maintain said ideal shape under said normal internal operating pressures of the rotary lobe pump without additional support from the outer casing (15, 115), but would expand beyond said shape;

said insert housing fits closely enough in said outer casing that under said normal internal operating pressure said insert housing expands against walls of said metal outer casing so said outer casing prevents further expansion of portions of the insert housing beyond said ideal shape.

5. The replaceable insert of claim 4, including a seal (31) lying around each rotor, for preventing fluid in the pumping chamber from leaking into said metal outer casing.

6. The replaceable insert of claim 4, wherein:

the pumping chamber and the lobes of the lobed rotors (27, 29) taper down in the axial direction from a front to a rear of the insert, so that the insert is insertable in the outer casing (15) in one orientation and lies in a close fit in the pumping chamber when fully inserted in said one direction.

7. A rotary lobe pump for pumping fluid, comprising:

a pump body (3) with casing body walls that form a casing cavity (15);

a pair of pump shafts (11, 13) rotatably coupled to said casing body walls;

an insert (5) that fits closely in said cavity, said insert including a shell (19, 21) that fits closely in said casing cavity, said shell forming inlet and outlet ports (23, 25), said shell forming a plurality of shaft apertures (40) for receiving said pump shafts, said shell having walls forming a pumping chamber (20), and said insert including a pair of lobed rotors that are coupled to said pump shafts and that are rotatable in said pumping chamber and that are rotatably sealed to the walls of said pumping chamber;

said pumping chamber of said shell being sealed to walls of said casing cavity so pumped fluid comes in contact with walls of said insert but not with walls of said casing cavity or with said pump shafts, to enable the replacement of one insert with another one while preventing cross-contamination of pumped fluids pumped by said one insert with fluid pumped by said another one of said inserts.

8. The insert of claim 7, wherein:

said casing that forms an insert-receiving cavity (15) that is formed of metal and that has a high rigidity, and said plastic shell of said insert is formed of plastic and has a lower rigidity than said casing, and said plastic shell lies closely within said cavity of said metal casing;

said plastic shell walls forming a pumping chamber are too weak to enable said lobed rotors to normally pump fluid, until supported against excessive expansion by cavity walls of said metal casing.

9. The pump described in claim 7 wherein:

said lobed rotors have axes;

the outside of said plastic shell walls that form a pumping chamber, and the metal walls of said cavity are both tapered in directions parallel to said axes, to enable the insert to be inserted and removed from said cavity and to be tightly held when fully inserted into the cavity.

10. The insert of claim 7, wherein:

the insert is sterile and contained in sealed packaging, but said casing body walls are not sterile.

* * * * *